United States Patent [19]

Lass

[11] 4,127,434

[45] Nov. 28, 1978

[54] DRY WALL TAPING MACHINE HAVING PNEUMATIC ASSISTED OPERATION

[75] Inventor: Harold M. Lass, San Jose, Calif.

[73] Assignee: Corban Industries, Inc., San Jose, Calif.

[21] Appl. No.: 815,838

[22] Filed: Jul. 5, 1977

Related U.S. Application Data

[63] Continuation-in-part of Ser. No. 739,519, Nov. 8, 1976, abandoned.

[51] Int. Cl.[2] ..... B32B 31/00; B44C 7/04

[52] U.S. Cl. ..... 156/526; 156/575

[58] Field of Search ..... 156/526, 575, 574, 577, 156/579, 523, 524

[56] References Cited

U.S. PATENT DOCUMENTS

| | | | |
|---|---|---|---|
| 2,815,142 | 12/1957 | Ames | 156/575 |
| 3,116,195 | 12/1963 | Lathrop et al. | 156/575 |
| 3,707,427 | 12/1972 | Erickson | 156/575 |
| 3,960,643 | 6/1976 | Dargitz | 156/575 |

*Primary Examiner*—Douglas J. Drummond
*Attorney, Agent, or Firm*—Harry E. Aine; Harvey G. Lowhurst

[57] ABSTRACT

A hand operated dry wall taping machine includes an elongated tubular body, to be held by the operator, having a tape applicator head portion at the end thereof adjacent the seam being taped. A supply roll of tape is carried from the tubular body. The applicator head includes a dry wall cement dispensing box through which the dry wall tape is fed. Cement is dispensed onto the side of the tape which is to face the wall being taped. A rotary tape shear is disposed up-tape from the cement dispensing box. A thumb actuated pneumatically operated cylinder actuates the rotary shear at the end of the seam being taped and advances a short length of tape through the cement dispensing box in readiness to commence taping of the next seam. A whisker valve in an air line is actuated by the pneumatically operated cylinder for delivering a momentary blast of air into the cement dispensing box for feeding mud onto the advanced leading end of the sheared tape. A second thumb actuated pneumatically operated cylinder controls operation of a cornering wheel for folding the cement laden tape into corner seams. A third thumb actuated pneumatically operated cylinder controls the supply of dry wall cement to the cement dispensing box from a tank of mud carried from the body of the operator, such tank being pressurized with air from an air compressor. The tank is connected via an air line to the air compressor which is carried from a hand truck. The air line is payed out from a spring loaded reel also carried from the hand truck.

14 Claims, 13 Drawing Figures

DRY WALL TAPING MACHINE HAVING PNEUMATIC ASSISTED OPERATION

RELATED CASES

The present application is a continuation-in-part application of parent application Ser. No. 739,519 filed Nov. 8, 1976 now abandoned.

BACKGROUND OF THE INVENTION

The present invention relates in general to dry wall taping machines and more particularly to pneumatically assisted dry wall taping machines.

DESCRIPTION OF THE PRIOR ART

Heretofore, pneumatics have been employed for feeding dry wall cement from a pressurized mud tank via a mud line connected to the dry wall taping tool. Such a tool is disclosed in U.S. Pat. No. 3,007,837 issued Nov. 7, 1961.

It is also known from the prior art to supply dry wall cement to a hand held dry wall taping tool via a mud line or hose wherein mud is pumped through the hose to the tool by means of a mud pump driven from a gasoline engine. Such a dry wall tape applicator is disclosed in U.S. Pat. No. 3,116,195 issued Dec. 31, 1963.

While it has been known to use pneumatic power for supplying dry wall cement to the dry wall taping tool, this pneumatic power has not been employed for assisting other operations of the dry wall taping tool, such as actuating the cornering wheel, severing the tape and advancing the tape. These functions have heretofore been manually operated. The most common method of operation is the provision of a sleeve which slides on the barrel-like handle of the taping tool. The sleeve is coupled to the various devices such as the cornering wheel, tape shear and the like, for operation thereof in response to either forward or rearward movement of the sleeve on the barrel. An example of such a manually operated taping tool is found in U.S. Pat. No. 3,260,638 issued July 12, 1966.

While the aforecited prior art dry wall taping tools have been satisfactory for some applications, it is desirable to provide a more automated dry wall taping tool and one in which the various operations of the tool are power driven.

SUMMARY OF THE PRESENT INVENTION

The principal object of the present invention is the provision of an improved dry wall taping machine.

In one feature of the present invention, a pneumatically powered tape severing device or shear is employed for severing the tape at the end of the seam being taped.

In another feature of the present invention, a pneumatically powered device is employed for advancing the leading end of the severed tape through the dry wall cement dispensing station in readiness to commence taping of the next seam.

In another feature of the present invention, an air valve is operatively associated with the tape advance mechanism in such a manner such that as the severed end of the tape is advanced through the cement dispensing station an impulse of pneumatic pressure is delivered to the cement dispensing box for dispensing a sufficient amount of cement therefrom to cover the advanced leading end of the tape.

In another feature of the present invention, a supply tank of dry wall cement is carried from the shoulder of the operator, in use, and the tank is pressurized with compressed air from an air compressor via an air line carried upon a spring loaded reel. A hand actuated pneumatically controlled valve controls the feed of the dry wall cement from the tank to the cement dispensing box in the applicator head portion of the dry wall taping machine.

Other features and advantages of the present invention will become apparent upon a perusal of the following specification taken in connection with the accompanying drawings wherein:

DESCRIPTION OF THE PREFERRED EMBODIMENTS

Figure 1:
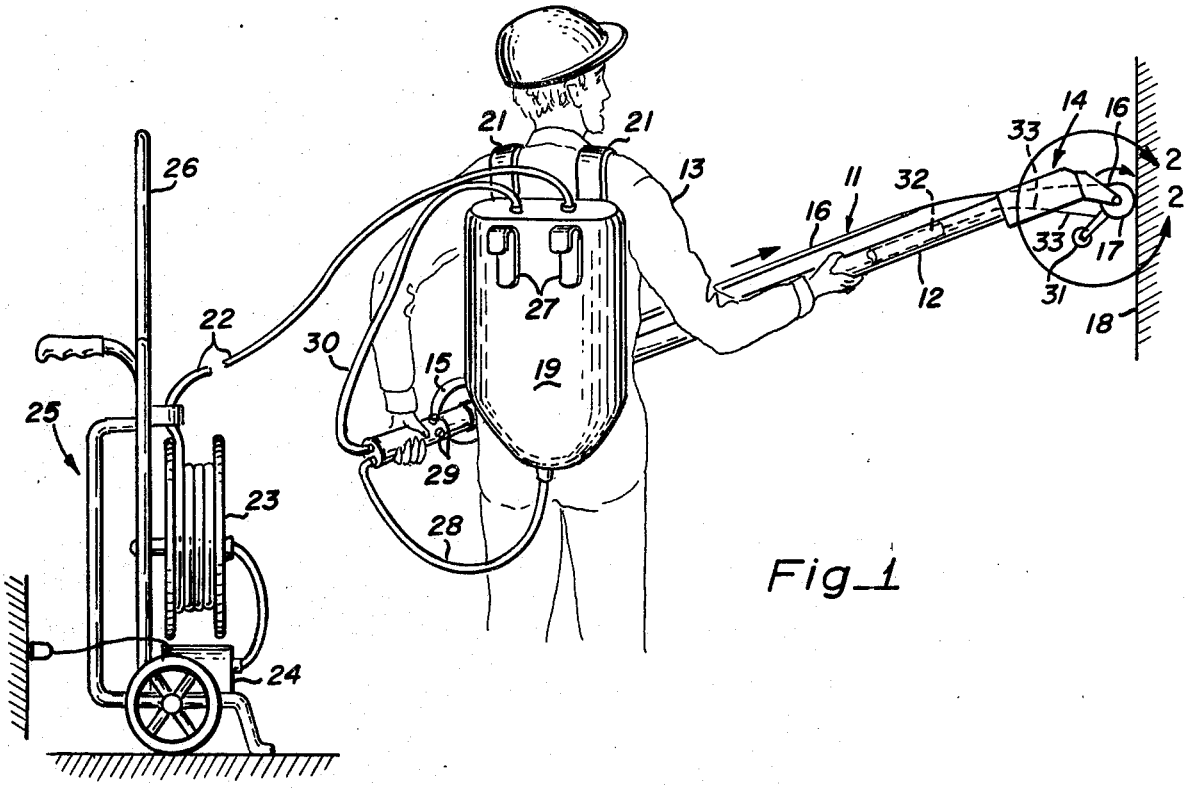
FIG. 1 is a side elevational view of a dry wall taping machine in use.

Referring now to FIG. 1, there is shown a dry wall taping tool 11 of the present invention. More particularly, the dry wall taping machine or tool 11 includes an elongated tubular body or barrel portion 12 to be hand held by the operator 13 so that an applicator head portion 14 of the tool 11 is disposed adjacent a seam which is to be taped between two adjoining sections of dry wall. A conventional supply roll 15 of dry wall tape 16 is carried on a support pivotably affixed to the body or barrel 12. Tape 16 is fed from the roll through the applicator head portion 14 over a pair of tape drive wheels 17 which press the marginal edges of the tape 16 into engagement with the wall 18 and which in so doing serve to pull the tape 16 from the roll 15.

The tape 16 is drawn through a dry wall cement dispenser box portion 49 of the head 14 (which may be of conventional design as disclosed by the aforecited U.S. Pat. No. 3,116,195 or of an improved design as disclosed in copending U.S. application Ser. No.

739,517 filed Nov. 8, 1976) wherein dry wall cement is dispensed onto the upper surface of the tape so that, as the tape is applied to the wall 18, cement is trapped between the tape and the wall. A tape shear, disposed in the applicator head 14 and more fully disclosed below with regard to FIGS. 2 and 6, shears the tape upon completion of the taping of a given seam. The shear is actuated by the operator when the end of the seam being tape is reached. The tape shear may be of conventional design as disclosed in the aforecited U.S. Pat. No. 3,116,195.

The dry wall cement is supplied to the applicator head 14 from a tank 19 carried via shoulder straps 21 from the shoulder of the operator 13. The cement tank 19 contains a supply of dry wall cement and the tank is pressurized to a pressure of 35–40 psi via an air line 22 wound on a spring loaded supply reel 23 and thence connected to an air compressor 24 via a suitable pressure regulator, not shown. The compressor and supply reel are carried from a hand truck 25 which includes a vertically extendable frame member 26 to receive and support the tank, when not in use, via hooks 27 affixed to the tank and hooked over an upper horizontal cross member of the frame 26.

Dry wall cement is supplied from the tank 19 to the taping tool 11 via flexible plastic tubing 28. Suitable thumb operated valves 29 are disposed at the outer end of the main body 12 for operation by the operator for controlling certain functions of the taping tool 11. One valve controls the flow of dry wall cement from the tank 19 to the applicator head 14. Another valve controls air pressure to a pneumatic cylinder for operating the shear and for advancing the leading end of the tape 16. Another valve controls air pressure to a second pneumatic cylinder 32 for operating a cornering wheel 31. The pneumatically operated cylinder 32 is mechanically coupled to the cornering wheel 31 via a cable 33 such that when the air pressure as supplied to the pneumatic cylinder 32 is relieved a spring mechanically associated with the cornering wheel 39, pivots the cornering wheel into the operating position where it remains so long as the operator depresses the pneumatic control valve for releasing the pressure on the cylinder 32. After the cornering wheel operation is completed, the operator releases the pneumatic control valve and reapplies the pressure to the cylinder 32, thereby withdrawing the cornering wheel via cable 33 against its associated spring force. After the tape has been applied to the wall, conventional finishing tools are employed for smoothing the tape 16 and removing the excess dry wall cement.

Referring now to FIGS. 2–6, the various features of the tape tool 11 will be explained in greater detail. The tape 16 to be applied to the dry wall joint being taped is fed from the supply roll 15 through a guide 41 and over a tape advance roller 42. Three rubber O-rings 43 are coaxially mounted at the periphery of the roller 42 to provide a frictional contact with the tape 16. Spring loaded rollers 44 press the tape 16 into engagement with the O-rings 43. The tape advance roller 42 is coupled to a pinion gear 45 which is actuated by means of a rack 46 for frictionally driving the leading end of the severed tape forward at the end of the tape shearing operation, to be more fully described below.

The tape 16 is fed via additional paper guides 47 through a shear housing 48 and thence through a dry wall cement dispensing box 49 wherein dry wall cement is applied to the upper surface of the tape. The cement laden tape then passes over the tape drive wheels 17 and onto the wall 18 being taped.

Figure 6:
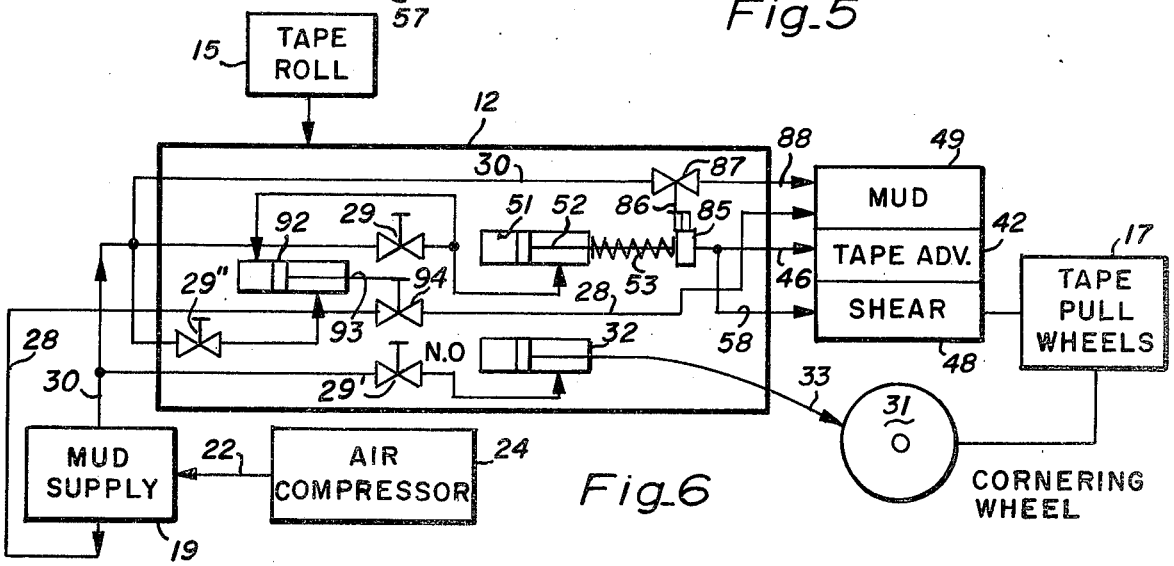
FIG. 6 is a schematic diagram, partly in block diagram form, of the dry wall taping machine of the present invention.

A thumb actuated tape shear pneumatically powered cylinder 51 is contained within the tubular handle 12 (see FIG. 6). The pneumatic cylinder 51 is supplied with air pressure from an air line 30 interconnecting the tank 19 with the tool 11 via one of the suitable control valves 29. The rack 46 is coupled to a drive shaft 52 of the pneumatic cylinder 51 and a compression spring 53 is coaxially mounted between the rack 46 and the pneumatic cylinder 51 for compression as the rack 46 is moved back toward the pneumatic cylinder 51. A pawl 54 (see FIG. 5) is carried at the end of the rack 46. The rack 46 slides to and fro in a bore 55 having a slot 56 communicating through the side wall thereof through which the pawl 54 follows the contour of the back wall 55 of the bore which is recessed near its forward end at 55'. The pawl 54 includes an inclined forward face portion 57 which, upon engaging a rotary shear actuating lever 58 when moving forward, causes the pawl 54 to move over and follow the recessed contour 55' of the bore 55 thereby passing by the shear actuating lever 58. The pawl 54 follows the contour 55' to a forwardmost position as indicated by the dotted lines at the terminal end of the forward stroke of the rack 46.

Figure 10:
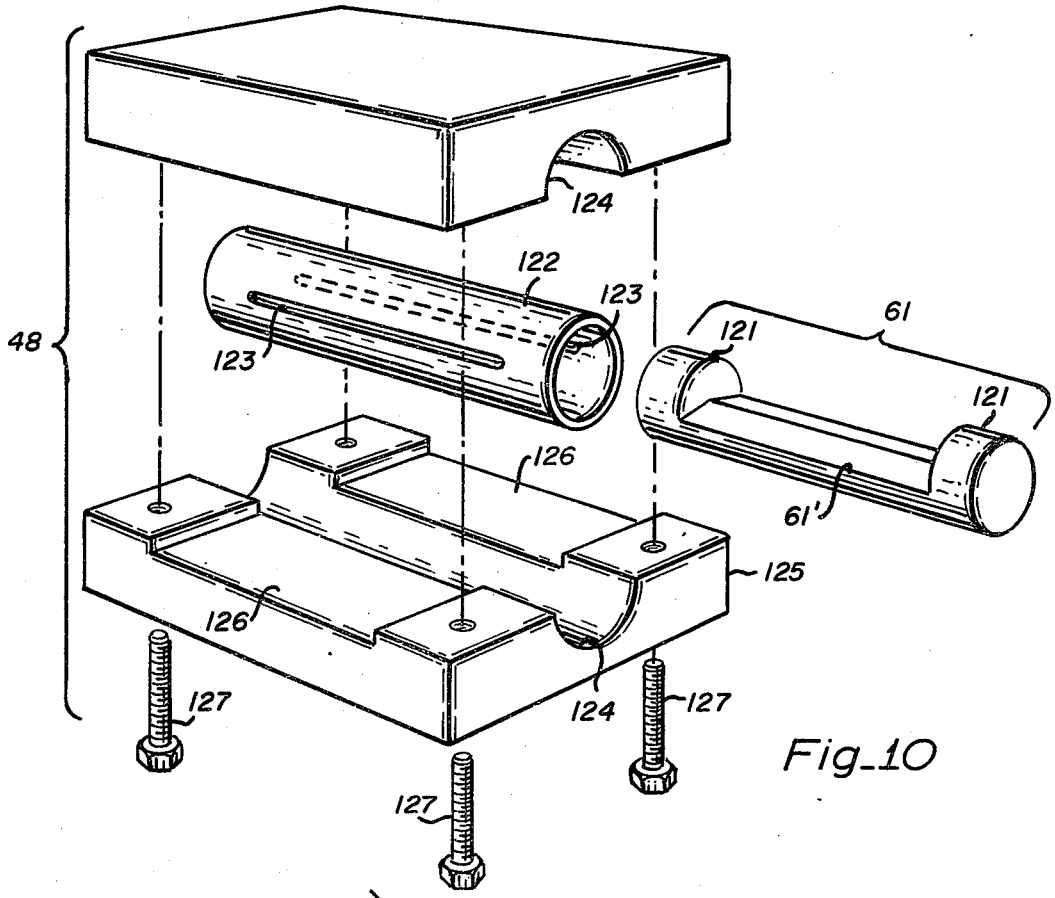
FIG. 10 is an enlarged vertically exploded view of the tape shear assembly.

The shear actuating arm 58 is coupled at hub 59 to one end of a rotatable knife member 61, as of steel. The rotary paper shear may be of conventional design as disclosed in British patent Ser. No. 1,032,949 published June 15, 1966 but in a preferred embodiment is as follows: The rotatable knife includes a sharpened blade portion 61' at the periphery of a cylindrical sector of the knife 61. Opposite ends of the knife 61 (see FIGS. 10 and 11) include cylindrical bearing portions 121 which bear on the inside cylindrical surface of a cylindrical sleeve 122, as of steel. The steel sleeve is axially slotted at diametrically opposed portions 123 for passage of the tape 16 therethrough. The knife 61 is coaxially disposed within the interior of the cylindrical sleeve and the sleeve and knife assembly is held within a cylindrical bore 124 in the split block or housing 48, as of aluminum. The lower half 125 of the split block housing is recessed at its upper surface at 126 to provide a slot passing through the shear block assembly 48 for passage of the tape therethrough. The split block is held together by cap screws 127.

A tension spring 62 (FIG. 2) is coupled to a set screw 63 on the lever arm 58 and is carried within a recess 64 in the head 14 for spring biasing the lever arm in the counterclockwise direction. All sides of the applicator head 14 are closed by cover plates, not shown.

The pinion gear 45 is coupled to the tape advance roller 42 via the intermediary of a spring clutch 68 so that when the rack 46 is moving in the rearwardly direction the tape advance roller 42 is essentially decoupled from the pinion 45. On the other hand, when the rack 46 is moving in the forwardly direction the pinion gear drives the tape advance roller 42 so as to advance the tape through the cement dispensing box 49. The auxiliary friction wheels 44 are coupled to an axle 69 carried from a first yoke member 71 which in turn is pivotably coupled to a second yoke member 72 via a pin 73. The second yoke member 72 is carried via apertured arm portions from and fixedly secured to an axle 74 for rotation therewith. The yokes 71 and 72 and axle 74 are spring biased by means of a torsion spring 75 carried on the axle 74 intermediate the arm portions of the yoke 72. One end of the torsion spring 75 at 76 presses against the yoke 72 so as to force the auxiliary frictional drive wheels 44 into engagement with the O-rings 43. The other end of the torsion spring 75 at 77 is captured to a portion of the tubular body 12.

One end of the axle 74 (FIG. 2) is pivotably mounted in the housing and a lever arm 80 is fixedly secured to the axle 74 for imparting rotation thereto against the spring force of spring 75. A second lever 78 is fixedly secured to a shaft 79 which rides in a bore 81. The rearward end of the shaft 79 protrudes from the end of the bore 81 for engagement with a nut 82 carried from the rack 46 for movement therewith. A compression spring 83 is carried within a recess 84 in the block and is disposed in compression against the end of the lever arm 78.

When the rack 46 is in its forwardmost position, as it is for taping of the wall, the nut 82 bears against the end of the shaft 81 compressing the spring 83 and forcing the first lever arm 78 against the end of the second lever arm 77 for pivoting the auxiliary friction wheels 44 out of engagement with the O-rings 43 on the tape drive roller 42 thereby permitting the tape drive wheels 17 to pull the tape through the applicator head portion 14. However, when the paper shearing function commences and the pneumatically powered piston 51 serves to withdraw the rack 46 to commence the shearing of the tape at the end of a seam, the nut 82 is moved rearwardly from the end of and out of engagement with the shaft 81 so that the spring action of the torsion spring 75 can pivot the auxiliary drive wheels 44 into frictional engagement with the tape 16 and the O-rings 43. This friction loading prevents the tape 16 from being driven rearwardly and so that the spring clutch 68 will serve to disengage the pinion 45 from the tape advance roller 42. However, after the shearing cycle is completed the rack 46 returns forwardly and, in the process, drives the pinion gear 45 in the tape advance direction which in turn is coupled via the clutch to the tape advance roller 42 for advancing the leading end of the tape 16 through the shear block 48 and cement dispensing box 49.

Figure 4:
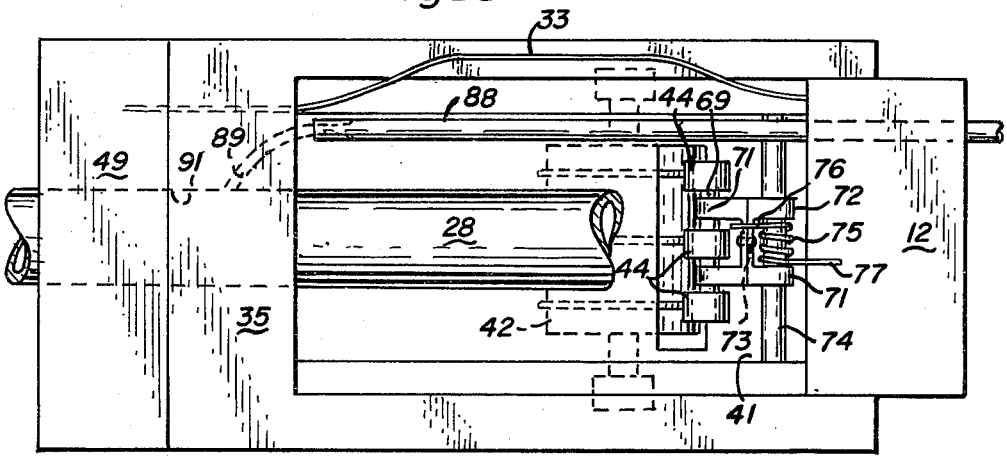
FIG. 4 is a top view of the structure of FIG. 2 taken along line 4—4 in the direction of the arrows.
Figure 5:
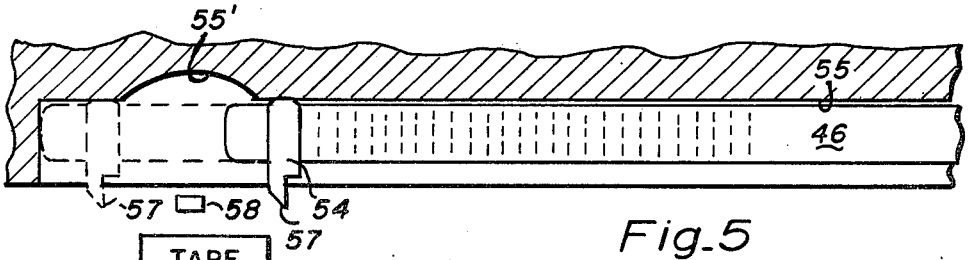
FIG. 5 is an enlarged partial cross sectional view of a portion of the structure of FIG. 2 taken along line 5—5 in the direction of the arrows.

A tab 85 (FIGS. 6 and 13) is coupled to the drive shaft 52 of the shear actuating cylinder 51 for engaging an actuating lever 86 of a conventional whisker valve 87 connected in series with the air line 30 and a tubulation 88 which is connected into the dry wall cement conduit 28 (FIG. 4) near the cement dispensing box 49 via a bore 89 passing through a portion of the housing 35 of the applicator head portion 14 (see FIGS. 4 and 6). The cement conduit 28 is connected into the cement dispensing box 49 via the intermediary of a bore 91 in the housing 35 which is intersected by the smaller bore 89 coupled to the air line 88. When the shear cylinder 51 is actuated via valve 29, the drive shaft 52 of the cylinder 51 is retracted shearing the paper and causing tabe 85 to actuate the whisker valve 87 causing a momentary blast of air derived from air line 30 to be applied to the cement dispensing box 59 for forcing sufficient cement from the box onto the leading end of the tape to cover approximately 5 inches of tape which is automatically advanced through the cement dispensing box 49 via the forward travel of the rack 46.

Figure 11:
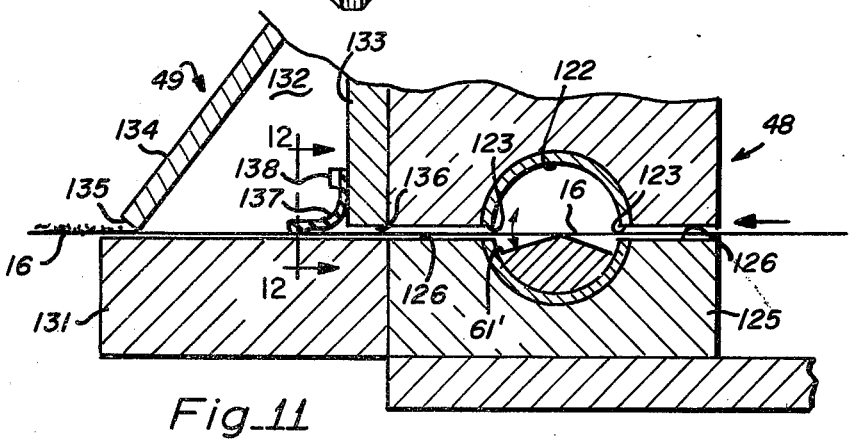
FIG. 11 is an enlarged cross-sectional view of a portion of the structure of FIG. 2 delineated by line 11—11.
Figure 12:
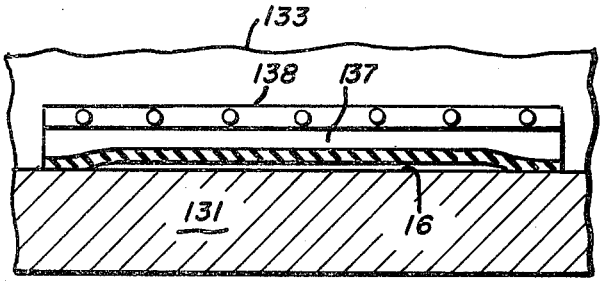
FIG. 12 is a sectional view of the structure of FIG. 11 taken along line 12—12 in the direction of the arrows.

Referring now to FIGS. 11 and 12, the details of the mud dispending box 49 is shown in greater detail. More particularly, the mud dispensing box 49 is disposed at the forwardmost wall of the rotary shear split block assembly 48. The mud dispensing box 49 includes a base plate portion 131, a pair of vertically directed side closing walls 132 disposed along the lateral side edges of the tape 16. In addition, the box 49 includes a rear wall 133 abutting the forward wall of the split block member 48 of the rotary shear. The rear wall 133 includes an opening passing therethrough, not shown, for supplying mud into the interior of the mud dispensing box 49 under pressure from the mud supply via hose or conduit 28.

The forward end of the mud dispensing box 49 is closed off by means of an inclined plate 134, the lower lip of which at 135, defines a passageway through which the tape emerges from the cement dispensing box 49 and the height of the lower lip 135 over the base plate 131 defines the height of a mud dispensing slot for leveling and controlling the thickness of the mud as deposited by the mud dispensing box 49 on the tape 16.

The back wall 133 of the mud dispensing box includes a rear slot 136 in alignment with slot 126 in the shear block 48 for passage of the tape 16 through the shear block 48 and thence through the back wall 133 of the mud dispensing box into the mud dispensing box and thence through the forward slot at 135 and over the tape drive wheels 17 and onto the wall 18. Rear slot 136 is sealed by means of a thin pliable flap 137 of material such as 0.005 inch thick Teflon sheet material captured to the back wall 133 of the mud dispensing box, internally thereof, via a batten 138. The flap 137 extends laterally past the lateral side edges of the tape and slot 136 for sealing the slot 136 to prevent passage of mud contained within the mud dispensing box 49 under pressure back along the tape 16 and into the rotary shear where it could harden and cause sticking of the shear as well as excessive wear of the shear. The flap seal 137 and pressurized mud box forms the subject matter of and is claimed in copending U.S. application Ser. No. 739,517 filed Nov. 8, 1976.

Figure 13:
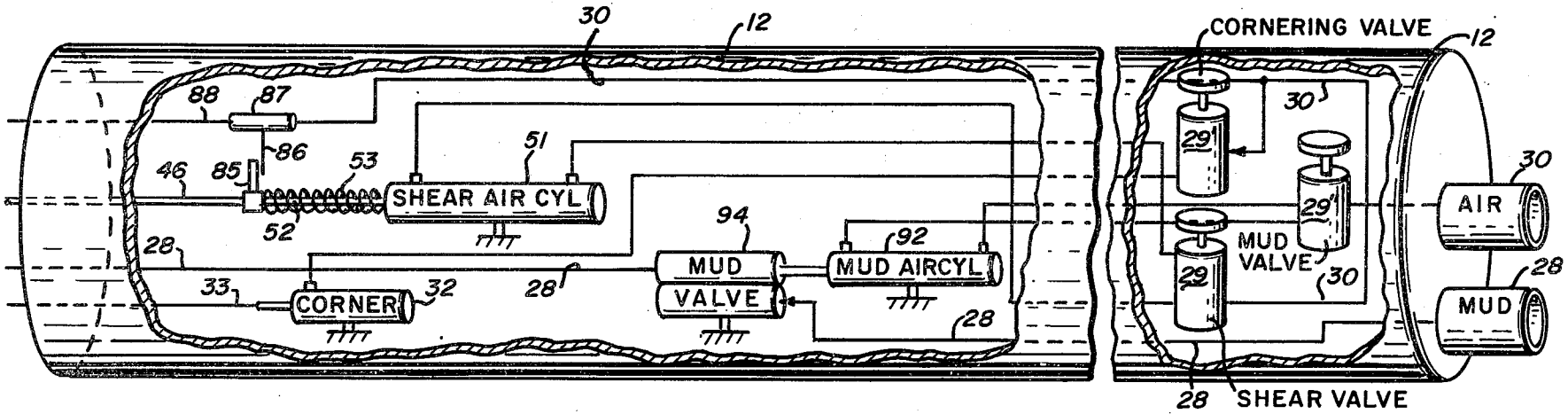
FIG. 13 is a longitudinally foreshortened, broken away view and partly line diagram form, of a physical realization of element 12 of FIG. 6.

Referring now to FIGS. 6 and 13, a third pneumatically powered cylinder 92 has its output shaft 93 coupled to a valve 94 series connected with the dry wall cement conduit 28 for controlling the flow of dry wall cement through the conduit 28 to the cement dispensing box 49. Cement is supplied to the cement dispensing box 49 by the operator periodically depressing an air valve 29" with his thumb. Air valve 29" is connected in the air line 30 so as to apply air pressure to one side of the pneumatically powered mud actuating cylinder 92 for opening the mud valve 94 and applying the dry wall cement to the cement dispensing box 49. At the end of taping a given seam, the operator manually depresses thumb actuated valve 29 which operates the shear cylinder 51 in a manner as aforedescribed. A portion of the output air, as derived at the output of valve 29, is fed back to the dry wall cement pneumatic actuating cylinder 92 for closing the mud valve 94.

The cornering wheel air valve 29' is normally open and is actuated by the thumb of the operator for releasing air pressure on the cornering wheel cylinder 32, thereby permitting the spring biased cornering wheel to pivot into position for folding the cement laden tape into a corner seam, as previously described.

Figure 2:
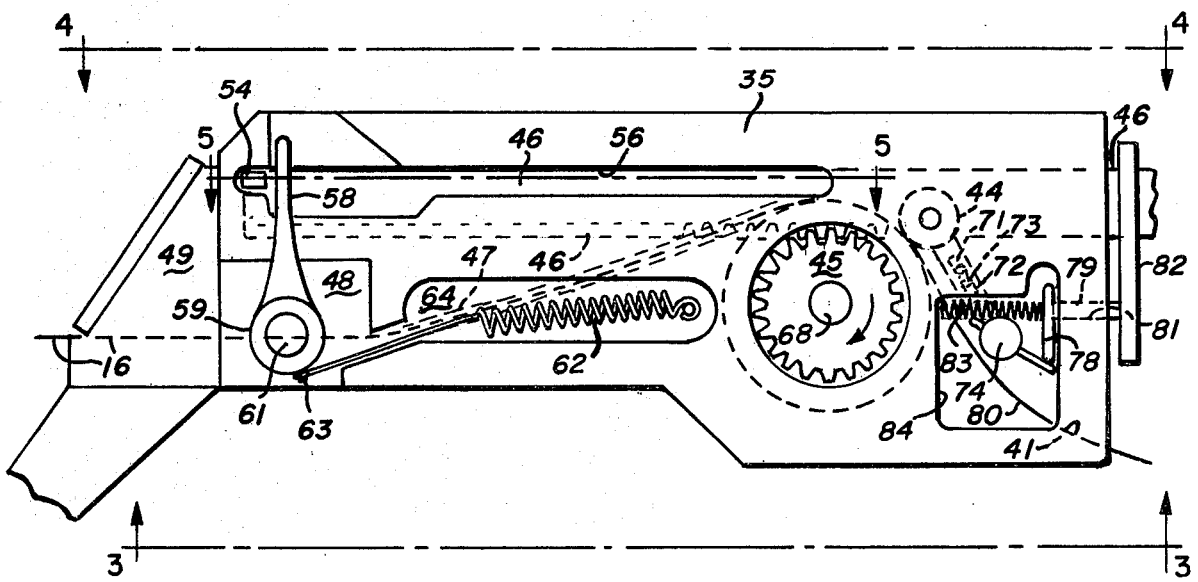
FIG. 2 is an enlarged detail view of a portion of the structure of FIG. 1 delineated by line 2—2 and partly broken away and turned end for end.
Figure 3:
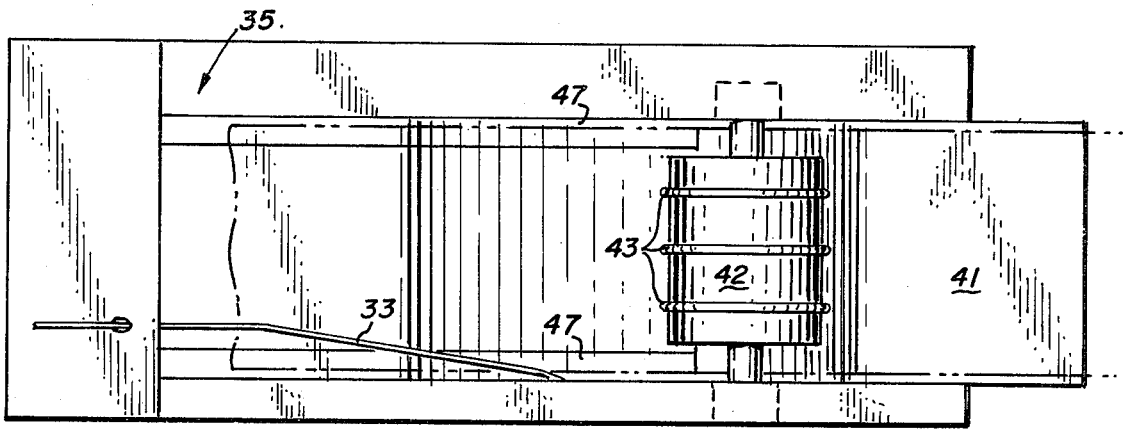
FIG. 3 is a bottom view of the structure of FIG. 2 taken along line 3—3 in the direction of the arrows.

In operation, the tape drive wheels 17 engage the marginal side edges of the cement laden tape 16 and as the applicator head 14 is moved upwardly along the seam in the wall to be taped, the serrated tape drive wheels 17 serve to pull the tape 16 from the supply roll 15 through the applicator head 14 and dry wall cement dispensing box 49 in which cement is dispensed onto the upper surface of the tape. When the operator gets to the end of the seam which is being taped, he manually depresses one of the shear/advance actuator valves 29, thereby applying air pressure via line 33 to the shear-/advance pneumatic cylinder 51. The pneumatic cylinder 51, prior to application of pressure thereto, is overpowered by the compression spring 53 so that the rack 46 is in the forwardmost position as indicated in FIG. 2 with the pawl 54 on the forward side of the lever arm 58.

When the air pressure is applied to the pneumatic cylinder 51 the cylinder retracts the rack 46. In retracting the rack 46, the pawl 54 catches the lever arm 58 in a notch 79 of the pawl 54 and moves the lever 58 in a clockwise direction, thereby causing the rotary shear knife 61 to rotate in a clockwise direction severing the tape 16. During the severing step, the lever arm 58 rotates through approximately 70° of rotation. As the rack is moving rearwardly, the pinion gear 45 is disconnected from the tape drive roller 42 via the intermediary of the spring clutch 68. The auxiliary spring loaded rollers 44 serve to prevent backward rotation of the tape drive roller 42. In addition, tab 85 actuates whisker valve 87 to apply a pressure impulse to the cement dispensing box 49.

After the tape 16 has been sheared and the rack 46 has retracted to its fully retracted position, the operator releases the air pressure from the pneumatic cylinder 51 by releasing the thumb control button 29. This causes the compression spring 53 to return the rack 46 to its forwardmost position. During the return of the rack 46, the pinion gear 45 engages the tape feed roller 42 via the clutch 68 causing the feed roller 42 to advance approximately 5½ inches of tape 16 through the shear block 68 and cement dispensing box 49 so that a leading end of the cement laden tape is ready to be pressed against the wall to begin taping of the next joint to be taped. After the tape 16 was sheared, the spring 62 returns the shear lever arm 58 and shear knife to the open position permitting the tape 16 to advance through the shear block 48.

The advantage of the pneumatically assisted dry wall taping machine 11 of the present invention is that actuation and operation of the various mechanisms such as the shear, cornering wheel, and control of the mud valve are all pneumatically assisted thereby assisting the operator in operation of the dry wall taping tool. In addition, the pneumatically operated shear cylinder 51, when actuated, automatically triggers the whisker valve 87 to supply an impulse of air pressure to the cement dispensing box for automatically feeding a sufficient amount of cement onto the leading end of the tape.

Figure 7:
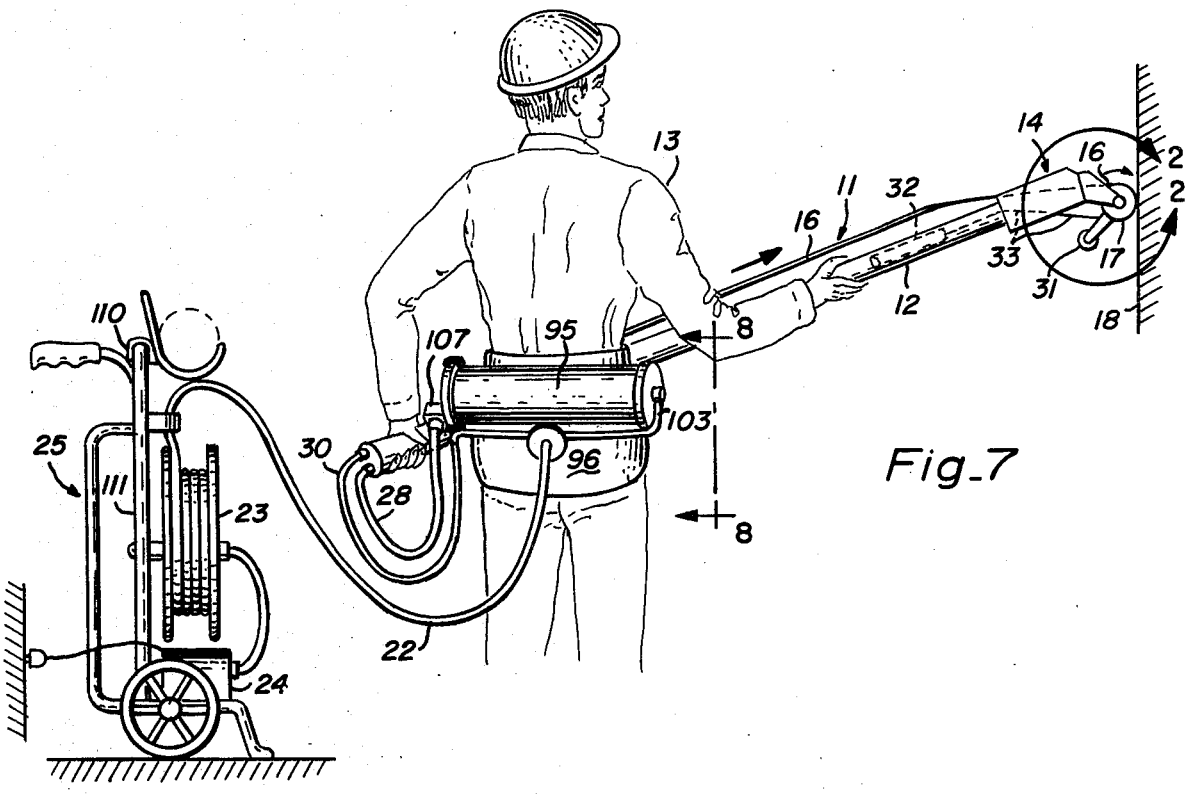
FIG. 7 is a view similar to that of FIG. 1 depicting an alternative dry wall cement container arrangement.
Figure 8:
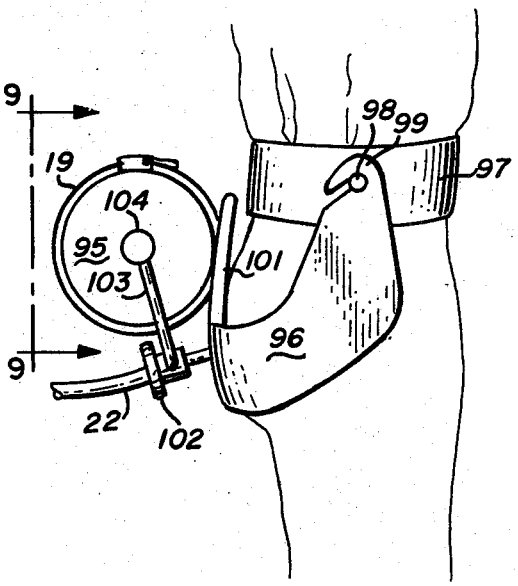
FIG. 8 is a view of the structure of FIG. 7 taken along line 8—8 in the direction of the arrows.
Figure 9:
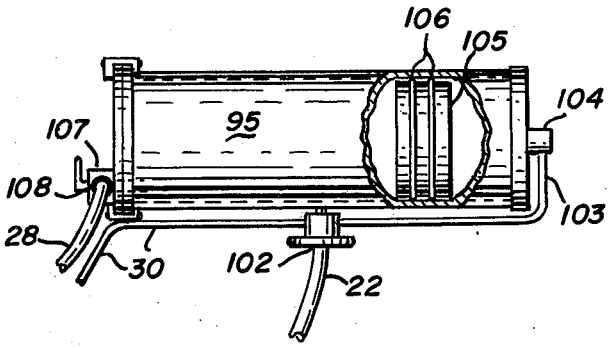
FIG. 9 is a view of the structure of FIG. 8 taken along line 9—9 in the direction of the arrows.

Referring now to FIGS. 7–9 there is shown an alternative embodiment of the dry wall cement tank 95 wherein the tank 95 comprises a cylindrical tank carried from the waist of the operator via the intermediary of a seat pan 96 and belt 97. The belt includes a pair of pins 98 projecting outwardly from the belt on opposite sides thereof to receive a hook-like portion 99 of the seat pan 96. The tank 95 is fixedly secured to an upwardly extending rear portion 101 of the seat pan 96. The air line 22 from the reel 23 is connected into a T fitting 102 carried from the tank 95.

A pair of air lines 30 and 103 are connected to opposite arms of the T connection 102. Line 103 feeds into one end of the cylindrical tank at 104 for pressurizing the inside of the tank 95 with air pressure at the pressure derived from the compressor 24. A piston 105 disposed within the cylindrical tank 95 is caused to move to and fro in the tank 95 in accordance with the pressure differential applied across the piston. The piston has a pair of piston rings 106, as of rubber, carried therefrom for sealing the piston 105 to the inside wall of the cylindrical tank 95.

Mud (dry wall cement) is carried in the tank on the side thereof remote from the side of the piston which is pressurized with air pressure derived from lines 22 and 103. A quick disconnect fitting 107 is coupled to the opposite end of the tank and in communication with the mud or dry wall cement inside the tank 95. The mud line 28 is coupled to the quick disconnect fitting 107 via quick disconnect coupling 108. The dry wall cement tank 95 is filled with dry wall cement by connecting a fill line to the quick disconnect coupler 108 and feeding mud into the tank via the quick disconnect fitting 107. As the mud is fed in under pressure, the piston 105 is moved axially of the tank to the right hand or input air side near input fitting 104. When the tank is filled with mud the mud fill line is disconnected from the quick disconnect coupler 108 and the mud line 28 is connected to the quick disconnect fitting 107 via quick disconnect coupler 108. During the mud or dry wall cement fill phase the air pressure is disconnected from the tank 95 so that the piston 105 can move under the pressure of the mud inputted to the tank. The air pressure is then applied to the air end of the tank 95 via air lines 22, 103 and input fitting 104. Mud is then supplied to the dry wall taping tool 11 in the manner as previously described with regards to FIGS. 1 and 6. For cleaning, both ends of the tank 95 are removed via opening clamps clamping the end plates onto opposite ends of the tank 95, to facilitate cleaning of the tank and the piston 105. The seat pan 96 is suitably cushioned on the inside thereof with foam cushioning material.

The hand truck 25 includes a pair of hooks 109 carried from a transverse member 110 interconnecting two side rails 111 of the hand truck 25. The hooks 109 receive the cylindrical tank 95 for support therefrom when the tank is not in use. The operator merely backs up to the hooks 109 and rests the tank 95 thereon thereby permitting the operator to unbuckle the belt 97.

The provision of the dry wall cement tank, as carried by the operator, greatly increases the mobility and convenience of the dry wall cement taping tool in that the operator can move about the room and from room to room without having to separately move his supply of dry wall cement. The spring loaded reel for paying out the air line 22 permits the operator to move from room to room while leaving the hand truck in a central location.

What is claimed is:

1. In a dry wall taping machine for applying tape to an elongated seam between adjoining sections of dry wall:

body means to be grasped by the operator for applying dry wall tape from a tape supply over a seam between adjacent sections of dry wall;

tape severing means carried from said body means for severing tape upon completion of the taping of a seam;

pneumatically powered means carried from said body means and mechanically operatively associated with said tape severing means for operating said tape severing means;

means for supplying pneumatic power to said pneumatically powered means;

control means carried from said body means and responsive to manual actuation by the operator for controlling the supply of pneumatic power to said pneumatically powered means and hence for controlling operation of said tape severing means;

dry wall cement dispensing means carried by said body means for dispensing dry wall cement onto the face of the dry wall tape which is to face the wall being taped; and tape advance means mechanically operatively associated with said pneumatically powered means for automatically advancing the leading end of the severed tape through said dry wall cement dispensing means.

2. The apparatus of claim 1 wherein said pneumatically powered means comprises a pneumatic powered actuating cylinder having a piston movable therein in response to pneumatic power supplied to one side of the piston within said cylinder.

3. The apparatus of claim 1 including container means for containing fluid dry wall cement;

dry wall cement conduit means for interconnecting said dry wall cement containing means and said dry wall cement dispensing means for conducting dry wall cement from said container means to said cement dispensing means; and means for supplying compressed air to said dry wall cement container means for pressurizing said container means and for forcing dry wall cement from said container means to said cement dispensing means through said dry wall conduit means.

4. The apparatus of claim 3 including second control means carried from said body means and responsive to manual actuation by the operator for controlling the flow of dry wall cement through said cement conduit means between said container means and said dry wall cement dispensing means.

5. The apparatus of claim 3 including carrying means for carrying said dry wall cement container means from the body of the operator in use.

6. The apparatus of claim 1 wherein said tape advance means includes tape drive means for engaging the tape and for pushing the leading end of the severed tape through said cement dispensing means.

7. The apparatus of claim 6 including means operatively associated with said tape advance means for momentarily increasing the pressure on the cement in said cement dispensing means for automatically dispensing dry wall cement onto that portion of the tape advanced through said cement dispensing means by said tape advance means.

8. The apparatus of claim 6 wherein said tape drive means includes a frictional drive wheel means for frictionally engaging the tape and for pushing the leading end of the severed tape through said cement dispensing means, pinion means coupled to said drive wheel means for rotationally driving said drive wheel means for advancing the tape, clutch means for rotationally decoupling said pinion means from said drive wheel means when said pinion means is rotated in the non-tape advance direction, pinion drive means mechanically operatively associated with said pneumatically powered means for engaging said pinion means and driving same in both a tape advance and tape non-advance direction with operation of said pneumatically powered means.

9. The apparatus of claim 8 wherein said pinion drive means includes a rack for engaging and driving said pinion means.

10. The apparatus of claim 1 including cornering wheel means pivotably carried from said body means for folding the tape into a corner seam, second pneumatically powered means for selectively pivoting said cornering wheel means into operating position, means for supplying pneumatic power to said second pneumatically powered means, and second control means carried from said body means and responsive to manual actuation by the operator for controlling the supply of pneumatic power to said second pneumatically powered means and hence for controlling operation of said cornering wheel means.

11. The apparatus of claim 10 wherein said second pneumatically powered means comprises a pneumatically powered actuating cylinder having a piston movable therein in response to pneumatic power supplied to one side of said piston within said cylinder.

12. In a dry wall taping machine for applying tape to an elongated seam between adjoining sections of dry wall:

body means to be grasped by the operator for applying dry wall tape from a tape supply over a seam between adjacent sections of dry wall;

tape severing means carried from said body means for severing the tape upon completion of the taping of a seam;

pneumatically powered means carried from said body means;

tape advance means mechanically operatively associated with said pneumatically powered means for automatically advancing the leading end of the severed tape; and said tape advance means including tape drive means for engaging the tape and for pushing the leading end of the severed tape forwardly.

13. The apparatus of claim 12 wherein said tape drive means includes a frictional drive roller means frictionally engaging the tape and for pushing the leading end of the severed tape forwardly, pinion means coupled to said drive roller means for rotationally driving said drive wheel means for advancing the tape, clutch means for rotationally decoupling said pinion means from said drive roller means when said pinion means is rotated in the non-tape advance direction, pinion drive means mechanically operatively associated with said pneumatically powered means for engaging said pinion means and driving same in both a tape advance and tape non-advance direction with operation of said pneumatically powered means.

14. The apparatus of claim 13 wherein said pinion drive means includes a rack for engaging and driving said pinion means.

* * * * *